US005194842A

United States Patent [19]

Lau et al.

[11] Patent Number: 5,194,842

[45] Date of Patent: Mar. 16, 1993

[54] THERMOSTAT DEVICE

[75] Inventors: Eric F. Lau, Granada Hills; Benjamin A. Hensley, deceased, late of Sun Valley; by Lawrence S. Cohen, legal representative, Los Angeles, all of Calif.

[73] Assignee: ITT Corporation, New York, N.Y.

[21] Appl. No.: 452,537

[22] Filed: Dec. 18, 1989

[51] Int. Cl.[5] ..... H01H 37/52; H01H 37/64

[52] U.S. Cl. ..... 337/373; 337/111; 335/207

[58] Field of Search ..... 337/111, 88, 373, 3; 335/205-207

[56] References Cited

U.S. PATENT DOCUMENTS 4,515,306 5/1985 Grant ..... 337/373

*Primary Examiner*—Harold Broome

*Attorney, Agent, or Firm*—Menotti J. Lombardi

[57] ABSTRACT

A thermostat device having a temperature responsive bimetal which permits movement of a permanent magnet between two fixed points to activate a reed switch element. The device includes a magnetic shunt for effecting a positive off position.

6 Claims, 2 Drawing Sheets

THERMOSTAT DEVICE

CROSS-REFERENCE TO RELATED APPLICATION

This application is related to pending application Ser. No. 372,783, filed Jun. 27, 1989, now U.S. Pat. No. D3,163,675, entitled Heat Thermostat, and assigned to the assignee of this application.

BACKGROUND OF THE INVENTION

This application relates to thermostat devices, and more particularly to thermostat devices with bimetallic and magnetic elements.

One type prior art thermostat is known from U.S. Pat. No. 3,656,082, wherein the thermostatic switch has a ferromagnetic armature which is normally attracted by a fixed magnet and is selectively attracted by a movable magnet fixed to a bimetal. Another type thermostat with a magnetic switch is shown in U.S. Pat. No. 3,593,236, wherein the switch points are enclosed in a glass structure and include an armature that is magnetically movable to effect different connection arrangements of the switch points.

In U.S. Pat. No. 4,748,432, a switch lever rotates a bimetal to set a desired temperature, and a stopper is employed to hold the contacts together so that regardless of the ambient temperature, the blower motor remains on. Room thermostats for controlling heating and cooling systems are also shown in U.S. Pat. No. 3,190,988, which illustrates an embodiment wherein a bimetal element carries on its free end a permanent magnet to activate a glass enclosed magnetically responsive switch. U.S. Pat. No. 3,171,003 describes a thermostat with a bimetal operated switching device in which a switch operator has a permanent magnetic with a variable reluctance shunt for changing the operation differential of the device.

Earlier prior art arrangements are also shown in U.S. Pat. Nos. 1,867,756 and 1,881,950. The '950 patent is of the type where the bimetallic member controls a mercury switch member, and the '756 patent is of the type where the bimetallic member controls movement of the armature arm of a magnetic.

In order to improve, simplify, and overcome limitations found in the foregoing and other prior art, it is an object of the invention to provide an improved thermostat device with a bimetallic element and a magnet positioned and movable to activate a reed switch.

SUMMARY OF THE INVENTION

According to the foregoing object and others the present invention is accomplished by means of a temperature responsive spiral bimetal having a magnetic positioned at one end which is movable between fixed points to activate a reed switch element.

A feature of the invention is that the arrangement includes a positive magnetic shunt to prevent activation of the reed switch element.

BRIEF DESCRIPTION OF THE DRAWINGS

The invention will become more apparent by reference to the following description taken in conjunction with the drawings, in which.

DETAILED DESCRIPTION OF THE PREFERRED EMBODIMENT

Figure 1:
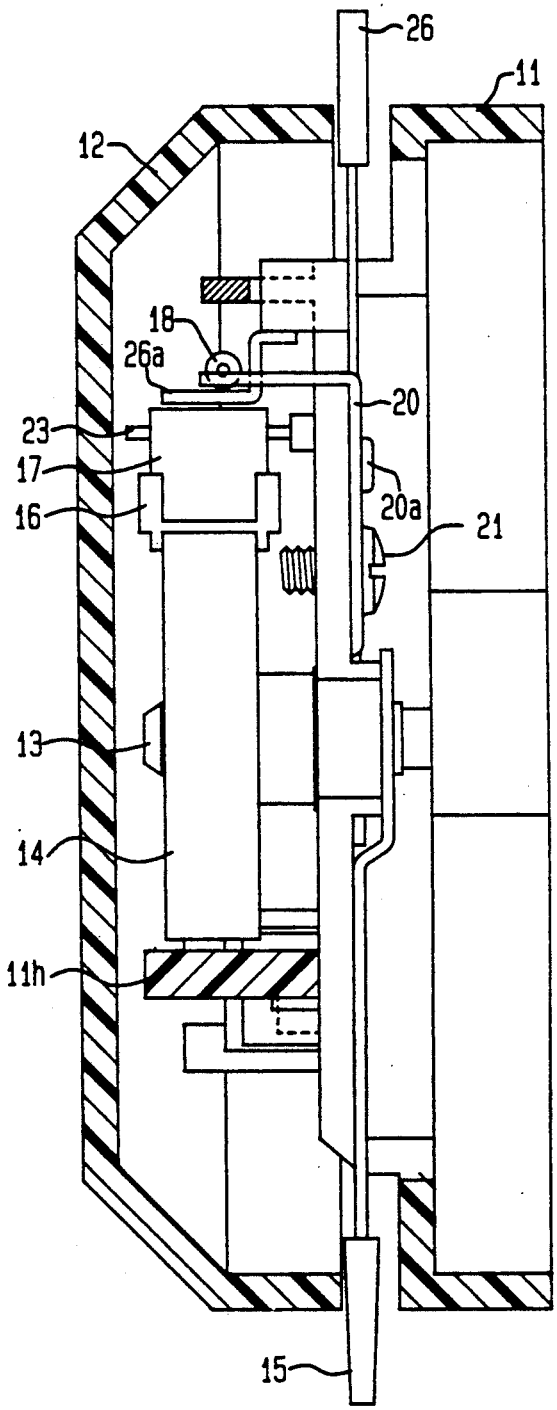
FIG. 1 illustrates in a cross-sectional view the thermostat device according to the invention.
Figure 2:
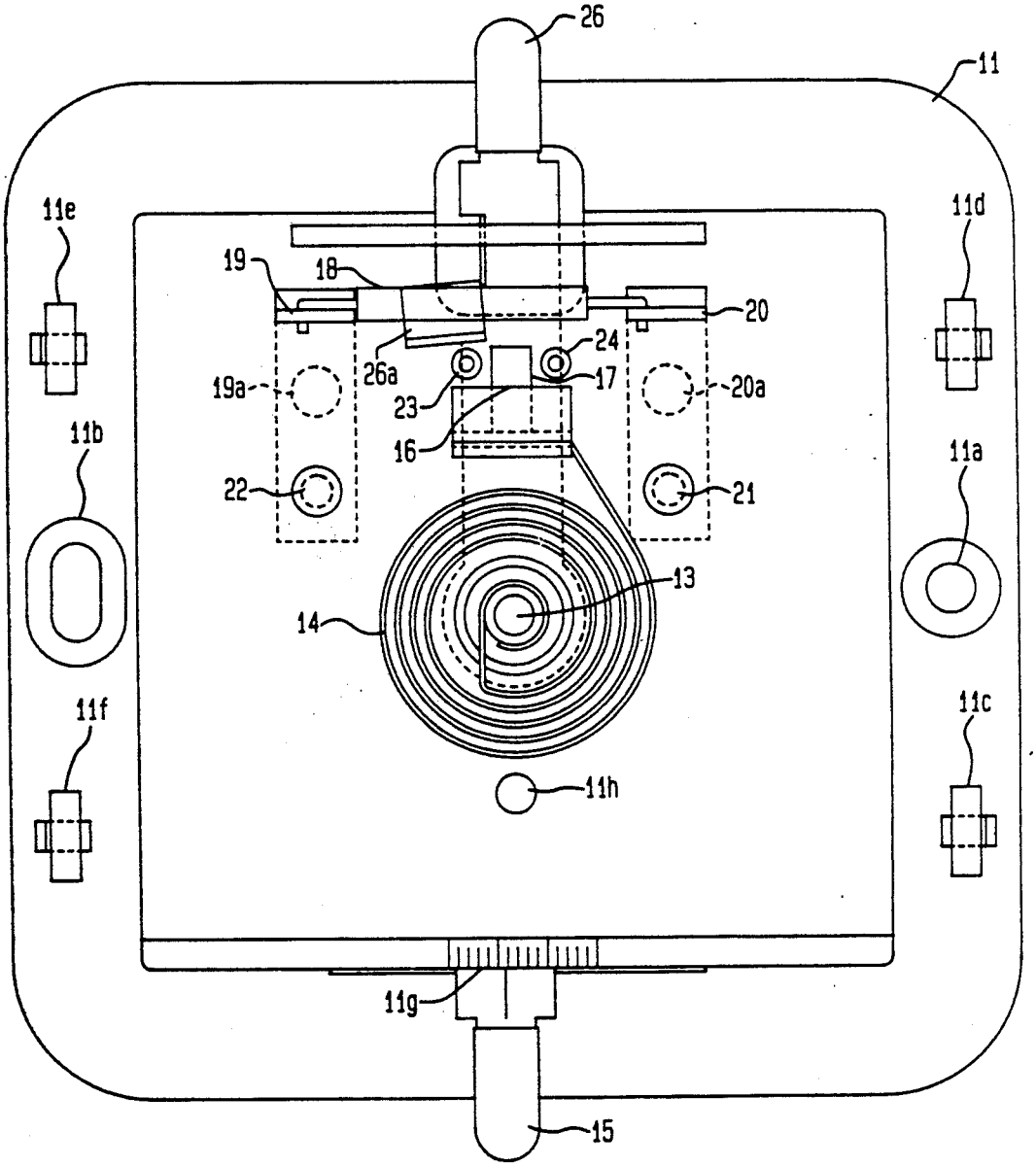
FIG. 2 illustrates in a frontal view of the device shown in FIG. 1 with the cover removed.

Referring now to FIGS. 1 and 2, the thermostat device according to the invention is illustrated. The plastic base 11 includes mounting holes 11*a,b* and raised plastic tabs 11*c-f* for snap mounting plastic cover 12. A metallic post 13 mounted in base 11 has mounted thereon a spiral bimetal 14. Adjusting lever 15 is mechanically connected to post 13 to adjust the mechanical tension on spiral bimetal 14 in accordance with the desired temperature setting indicated by markings 11*g* on the base 11.

A magnetic carrier 16 is fixed to the end of the spiral bimetal 14 and mechanically retains a permanent magnet 17. A reed switch 18 is mounted on terminals 19, 20 which are retained by pin inserts 19*a*, 20*a*. Screws 21, 22 are mounted in terminals 19, 20 and are used for connecting lead wires to the thermostat.

Magnet 17 is permitted to move between fixed restraining pins 23, 24. Pin 23 is the "on" position pin and pin 24 is the "off" position pin. When the adjusting lever 15 is moved to a position that represents a temperature lower than the ambient temperature, the bimetal 14 causes the magnet 17 to swing to the right or the "off" pin position. When the temperature setting is higher than the ambient temperature, the bimetal 14 causes the magnet to swing to the left or the "on" pin position activating reed switch 18 which in turn closes the control circuit connected to the thermostat.

A plastic retaining post 11*h* is positioned below the spiral bimetal 14. Post 11*h* prevents excessive movement of the magnet due to shocks, as may be encountered during shipment. Excessive movement causes flexure of the spiral bimetal which could result in displacement of the magnet 17 from its location between the pins 23, 24.

A positive "off" lever 26 is mounted on plastic base 11 and is movable from the position shown in FIG. 2 toward the right to the positive "off" position. Lever 26 includes a shunt tab 26*a* which, when the lever is moved toward the right, is positioned between the magnet 17 and the reed switch 18 to prevent magnetic activation of switch 18 regardless of adjustment level setting or the ambient temperature.

While the present invention has been disclosed in connection with the preferred embodiment thereof, it should be understood that there may be other embodiments which fall within the invention as defined by the following claims.

What is claimed is:

1. A thermostat device comprising;

a base of insulating material;

a post secured in said base;

a spiral bimetal, one end mounted on said post and the other end movable between two fixed points in response to ambient temperature;

a magnet mounted on said other end and movable between said two fixed points;

electrical terminals mounted in said base;

a reed switch mounted in said terminals, said reed switch being positioned to be activated by said magnet when said magnet is at one of said two fixed points;

an adjusting lever secured to said post for adjusting the temperature response of said bimetal; and an off lever being mounted on said base and having a magnetic shunt portion movable to prevent activation of said reed switch by said magnet.

2. The device according to claim 1 including an on pin positioned in one of said fixed points, and an off pin positioned in the other of said fixed points.

3. The device according to claim 1 including a non-metallic retaining pin to prevent displacement of said magnet from between said fixed points.

4. A thermostat device comprising:

a base and removable cover made of insulating material;

a post secured in said base;

a spiral bimetal, one end mounted on said post and the other end movable in response to ambient temperature;

a magnet mounted on said other end and movable between two pins mounted in said base;

terminal means in said base and a reed switch mounted in said terminal means, said reed switch being positioned adjacent said pins and being activated by said magnet when sad magnet is located at one of said two pins;

an adjusting lever secured to said post for adjusting the temperature response of said bimetal; and an off lever being mounted on said base and having a magnetic shunt portion movable to a position between said magnet and reed switch to prevent activation of said reed switch by said magnet.

5. The device according to claim 4 including a non-metallic retaining pin to prevent displacement of said magnet from between said two pins.

6. In combination:

an insulating base;

a post secured in said base;

a spiral bimetal, one end mounted on said post and the other end movable in response to ambient temperature;

a magnet mounted in a vertical plane on said other end and movable between first and second positions;

a pair of electrical terminals mounted in said base;

a reed switch being horizontally mounted in said pair of terminals and positioned adjacent said pins to be activated by said magnet when said magnet is at one of said two positions;

an adjusting lever secured to said post for adjusting the temperature response of said bimetal;

an off lever being mounted on said base and having a magnetic shunt portion movable to prevent activation of said reed switch by said magnet; and a non-metallic retaining pin to prevent displacement of said magnet from between said first and second positions.

* * * * *